US011432394B2

(12) United States Patent
Sakurai et al.

(10) Patent No.: US 11,432,394 B2
(45) Date of Patent: Aug. 30, 2022

(54) ACCELERATOR AND ACCELERATOR SYSTEM

(71) Applicant: RIKEN, Wako (JP)

(72) Inventors: Hiroyoshi Sakurai, Wako (JP); Hiroki Okuno, Wako (JP); Yoshiharu Mori, Wako (JP); Reiko Fujita, Tokyo (JP); Masatoshi Kawashima, Yokohama (JP)

(73) Assignee: RIKEN, Wako (JP)

( * ) Notice: Subject to any disclaimer, the term of this patent is extended or adjusted under 35 U.S.C. 154(b) by 0 days.

(21) Appl. No.: 16/963,658

(22) PCT Filed: Aug. 31, 2018

(86) PCT No.: PCT/JP2018/032453
§ 371 (c)(1),
(2) Date: Jul. 21, 2020

(87) PCT Pub. No.: WO2019/142389
PCT Pub. Date: Jul. 25, 2019

(65) Prior Publication Data

US 2021/0076482 A1 Mar. 11, 2021

(30) Foreign Application Priority Data

Jan. 22, 2018 (JP) ..... JP2018-008235

(51) Int. Cl.
*H05H 7/02* (2006.01)
*H05H 9/04* (2006.01)

(52) U.S. Cl.
CPC ..... *H05H 7/02* (2013.01); *H05H 9/04* (2013.01)

(58) Field of Classification Search
None
See application file for complete search history.

(56) References Cited

U.S. PATENT DOCUMENTS 5,757,009 A * 5/1998 Walstrom ..... G21K 1/093 250/396 ML
5,841,237 A * 11/1998 Alton ..... H05H 1/18 315/111.81

(Continued)

FOREIGN PATENT DOCUMENTS

JP 4-209500 A 7/1992
JP 6-231900 A 8/1994

(Continued)

OTHER PUBLICATIONS

Inaoka et al., "Study of Beam Capture Method for High Repetition Rate at Kyushu University", Proceedings of the 10th Annual Meeting of Particle Accelerator Society of Japan, Jun. 13, 2014, pp. 452-455.

(Continued)

*Primary Examiner* — Srinivas Sathiraju
(74) *Attorney, Agent, or Firm* — Birch, Stewart, Kolasch & Birch, LLP

(57) ABSTRACT

An accelerator (30, 40, 50) includes: a plurality of acceleration cavities (31, 41, 51) having one or two acceleration gaps; and a plurality of first control means (33, 43, 53) provided with respect to each of the plurality of acceleration cavities, each of the plurality of first control means independently generating an oscillating electric field and controlling a motion of an ion beam inside a corresponding acceleration cavity. In addition, M-number of multipole magnets (32, 42, 52) which generate a magnetic field and which control a motion of an ion beam may be provided downstream to N-number of acceleration cavities. The first control means independently controls acceleration voltage and a phase thereof and supplies radiofrequency power. Accordingly, particularly in a front stage of acceleration, a (Continued)

DC beam from an ion generation source can be adiabatically captured.

7 Claims, 8 Drawing Sheets

(56) References Cited

U.S. PATENT DOCUMENTS 6,476,399 B1 * 11/2002 Harrington ..... H01J 37/026 250/492.21
6,777,893 B1 * 8/2004 Swenson ..... H05H 7/22 315/505
7,554,275 B2 * 6/2009 Amaldi ..... H05H 6/00 250/492.3
7,898,193 B2 * 3/2011 Miller ..... H05H 9/04 315/505
8,575,868 B2 * 11/2013 Caporaso ..... H05H 7/00 315/505
8,624,528 B2 * 1/2014 Balakin ..... A61N 5/1049 315/503
8,907,309 B2 * 12/2014 Spotts ..... A61N 5/1039 250/492.3
8,933,651 B2 * 1/2015 Balakin ..... H05H 7/04 315/503
8,941,084 B2 * 1/2015 Balakin ..... A61N 5/107 250/492.3
9,629,230 B1 * 4/2017 Douglas ..... H05H 9/005
9,659,736 B2 * 5/2017 Rosenthal ..... H05H 1/02
10,051,721 B2 * 8/2018 Lombardi ..... H05H 7/04
10,245,448 B2 * 4/2019 Heese ..... G01T 1/02
10,362,666 B2 * 7/2019 Mustapha ..... H05H 7/02
10,566,169 B1 * 2/2020 Bennahmias ..... H01J 25/36
10,609,806 B2 * 3/2020 Roecken ..... A61N 5/1077
2003/0183779 A1 * 10/2003 Norimine ..... H05H 7/04 250/492.3
2004/0084634 A1 * 5/2004 Bechthold ..... H05H 7/04 250/492.3
2004/0108823 A1 * 6/2004 Amaldi ..... H05H 7/22 315/505
2004/0212331 A1 * 10/2004 Swenson ..... H05H 9/00 315/506
2005/0134204 A1 * 6/2005 Bechthold ..... H05H 7/04 315/500
2005/0247890 A1 * 11/2005 Norimine ..... H05H 7/04 250/492.3
2007/0164237 A1 * 7/2007 Bernhardt ..... H01J 37/3172 250/492.21
2007/0170994 A1 * 7/2007 Peggs ..... H05H 13/04 331/34
2008/0128641 A1 * 6/2008 Henley ..... H05H 7/10 250/492.21
2009/0302785 A1 * 12/2009 Miller ..... H05H 9/04 315/505
2010/0060208 A1 * 3/2010 Swenson ..... H05H 7/22 315/505
2010/0060209 A1 * 3/2010 Balakin ..... H05H 7/10 315/505
2010/0289409 A1 * 11/2010 Rosenthal ..... H05H 1/02 315/111.81
2010/0290575 A1 * 11/2010 Rosenthal ..... H01J 27/18 376/112
2012/0086364 A1 * 4/2012 Guethlein ..... H05H 7/08 315/505
2012/0126727 A1 * 5/2012 Hamm ..... H05H 9/045 315/505
2012/0181456 A1 * 7/2012 Chen ..... G21K 1/087 250/492.3
2012/0313003 A1 * 12/2012 Trbojevic ..... G21K 5/04 250/396 ML
2013/0038248 A1 * 2/2013 Yamamoto ..... H05H 9/042 315/505
2013/0051508 A1 * 2/2013 Mcintyre ..... G21G 1/08 376/194
2013/0092111 A1 * 4/2013 Hioka ..... F01L 13/0021 123/90.15
2015/0005567 A1 * 1/2015 Tsoupas ..... A61N 5/1077 600/1
2015/0362565 A1 * 12/2015 Sanfilippo ..... G01R 33/0005 324/251
2017/0238408 A1 * 8/2017 Lombardi ..... H05H 7/18 315/505
2017/0372867 A1 * 12/2017 Caspi ..... A61N 5/1081
2018/0047473 A1 * 2/2018 Fujita ..... G21F 9/30
2018/0292481 A1 * 10/2018 Niemann ..... H01F 7/0278
2019/0043631 A1 * 2/2019 Matsuzaki ..... G21G 4/08
2019/0239333 A1 * 8/2019 Aoki ..... H05H 7/08
2021/0076482 A1 * 3/2021 Sakurai ..... H05H 7/02

FOREIGN PATENT DOCUMENTS

JP 6-349599 A 12/1994
JP 11-283797 A 10/1999
JP 2001-85198 A 3/2001
WO WO 2019/043070 A2 3/2019

OTHER PUBLICATIONS

International Search Report (PCT/ISA/210) issued in PCT/JP2018/032453 dated Nov. 6, 2018.
Written Opinion (PCT/ISA/237) issued in PCT/JP2018/032453 dated Nov. 6, 2018.
Barni, "Status of the Trasco Project," The 10th Workshop on RF Superconductivity, Tsukuba, Japan, 2001, pp. 337-346, 10 pages total.
Biarrotte et al., "Design of the MYRRHA17-600 MeV Superconducting Linac," Proceedings of SRF2013, Paris, France, 2013, pp. 129-132, 4 pages total.
Biarrotte et al., "High-Intensity Protons SC Linac Using Spoke Cavities," Proceedings of EPAC, Paris, France, 2002, pp. 1010-1012, 3 pages total.
Extended European Search Report for European Application No. 18901222.2, dated Sep. 16, 2021.
Krawczyk et al.,"Design of a β=0.175 2-Gap Spoke Resonator," The 10th Workshop on RF Superconductivity, Tsukuba, Japan, 2001, pp. 485-488, 4 pages total.
Olry et al., "Recent Developments on Superconducting β035 and β015 Spoke Cavities at IPN for Low and Medium Energy Sections of Proton Linear Accelerators," Proceedings of EPAC, Lucerne, Switzerland, 2004, pp. 1003-1005, 3 pages total.
Plostinar et al., "Re-Bunching RF Cavities and Hybrid Quadrupoles for the RAL Front-End Test Stand (FETS)," Proceedings of EPAC, Edinburgh, Scotland, 2006, pp. 306-308, 3 pages total.

* cited by examiner

FIG. 8

| | 601 | 602 | 603 |
|---|---|---|---|
| | CONVENTIONAL METHOD (IFMIF) RFQ(1cm) | RFQ(10cm) | PRESENT METHOD (10cm) |
| BORE DIAMETER | 1cm | 10cm | 10cm |
| REQUIRED VOLTAGE | 80kV | 800kV | 300kV |
| ELECTRIC FIELD INTENSITY | 25MV/m | 25M/m | 3MV/m |
| DISCHARGE POWER LIMIT | 1.8 KILPATRICK | DISCHARGE POWER LIMIT OR HIGHER | SUFFICIENT MARGIN |
| Rf LOSS | 1MW | 100MW | <10MW |
| GAP SPACING | CONSTRAINED ($\beta\lambda/2$) | CONSTRAINED ($\beta\lambda/2$) | FREE |
| BUNCHING FUNCTION | AVAILABLE | AVAILABLE | AVAILABLE |

ACCELERATOR AND ACCELERATOR SYSTEM

TECHNICAL FIELD

The present invention relates to an accelerator and an accelerator system.

BACKGROUND ART

A linear accelerator system generally has a multi-stage configuration in which a plurality of accelerators are cascade-connected and a target beam is gradually accelerated to obtain a beam with desired energy. Since a large portion of fundamental characteristics of the finally-obtained beam is determined by a front-stage accelerator, the front-stage accelerator is particularly important. After the introduction of radiofrequency quadrupole accelerators (hereinafter, RFQ accelerators) in the 1970s, an RFQ accelerator is often used as a front-stage accelerator.

An RFQ accelerator has four electrodes, and by applying a radiofrequency voltage so that opposing electrodes have a same potential and adjacent electrodes have reverse potentials, acceleration, convergence, and adiabatic capture (bunching) of beams can be simultaneously performed. In this case, adiabatic capture refers to converting a DC beam from an ion source (an ion generation source) to have a bunch structure that enables radiofrequency acceleration.

One important research subject with respect to accelerators is increasing intensity (increasing current) of beams. A beam intensity of accelerators presently in operation is around 1 MW (megawatts) while a beam intensity of accelerators in planning stages is around 10 MW at a maximum. By contrast, for the purpose of establishing a nuclear transmutation method of high-level radioactive waste, the present inventors are in a process of developing an accelerator system capable of generating beam intensity in excess of 100 MW which is higher than conventional accelerator systems by one order of magnitude.

CITATION LIST

Patent Literature

[PTL 1] Japanese Patent Application Laid-open No. H11-283797

SUMMARY OF INVENTION

Technical Problem

An acceleration cavity of an accelerator has a large number of acceleration gaps, and a beam is accelerated in each acceleration gap using supplied radiofrequency power. Intergap spacing must be determined in accordance with a velocity of the beam so that acceleration is performed in each acceleration gap. In other words, a beam with a higher velocity requires a wider intergap spacing, resulting in a larger size and a higher cost of an apparatus.

In addition, when the aim is to increase intensity of a beam, an RFQ accelerator cannot be used since sufficient acceptance (a bore diameter) with respect to a beam diameter cannot be secured.

While an RFQ accelerator enables acceleration and convergence of a beam to be performed simultaneously, an upper limit of a beam diameter that can pass is around 1 cm.

This is because increasing the bore diameter of the RFQ accelerator results in a discharge power limit being reached.

In contrast, when beam intensity increases, a diameter of a beam (hereinafter, a beam diameter) supplied from an ion source increases. For example, when obtaining a 1 A deuteron beam from an ion source, the beam diameter is around 10 cm or more. A maximum current of a high-quality ion beam that can be extracted from a single hole is solely dependent on an extraction voltage and, for example, the maximum current is approximately 100 mA when extracting a 30 kV deuteron beam. Therefore, in order to obtain a 1 A beam, beams must be extracted from at least 10 porous electrodes and from around 30 porous electrodes when likelihoods of plasma characteristics and deuteron ratios are taken into consideration. Since excessively focusing a high-intensity beam results in an excessive space-charge force, a single hole diameter must be set to around 1 cm and, therefore, an entire beam diameter is, for example, around 10 cm, or further larger.

As described above, although an accelerator capable of accommodating a large beam diameter must be used in order to increase intensity of a beam, conventional RFQ accelerators cannot be used for this purpose.

In consideration of the problem in conventional art described above, an object of the present invention is to provide a low-cost accelerator capable of generating a high-intensity beam which is adiabatically captured, accelerated, and converged.

Solution to Problem

In order to solve the problem described above, an accelerator according to the present invention includes: a plurality of acceleration cavities having one or two acceleration gaps; and a plurality of first control means provided with respect to each of the plurality of acceleration cavities, each of the plurality of first control means independently controlling a motion of an ion beam inside a corresponding acceleration cavity.

In a present aspect, for example, the first control means may generate an oscillating electric field inside an acceleration cavity and may be capable of independently determining an amplitude and a phase of the electric field. In the present aspect, the first control means may supply radiofrequency power via an RF coupler, and the plurality of first control means may independently supply the radiofrequency power. The oscillating electric field supplied by the first control means controls a motion of an ion beam or, in other words, acceleration and adiabatic capture in a direction of travel inside an acceleration cavity.

Using acceleration cavities, each having one or two acceleration gaps, enables each acceleration cavity to be individually controlled. As a result, freedom of design of an apparatus is significantly improved. In an RFQ accelerator, spacing between adjacent gaps must be set to $\beta\lambda/2$ (where $\beta$=velocity/speed of light, $\lambda$=wavelength of radiofrequency wave, and $\beta\lambda$=distance traveled by a particle in one period), and the higher the velocity of a beam becomes, the larger the intergap spacing must be. With the accelerator according to the present invention, since an oscillating electric field can be independently controlled, spacing of acceleration cavities can be freely designed. In other words, intergap spacing can be reduced, which enables a total length of the accelerator to be reduced and, further, production cost to be reduced. In addition, an adiabatic capture function similar to that of RFQ can be imparted in a front stage of the accelerator.

The accelerator according to the present aspect may further include a second control means which generates a magnetic field and controls a motion of the ion beam. The second control means generates a DC magnetic field. In the present aspect, the second control means may be a multipole magnet, and a configuration in which M-number (where M is a natural number) of multipole magnets are connected downstream to N-number (where N is a natural number) of acceleration cavities may be repeated. Due to the DC magnetic field generated by the second control means, a motion of the ion beam in a transverse direction or, in other words, convergence of the ion beam is controlled.

In one embodiment, one acceleration cavity and one multipole magnet may be alternately connected (N=M=1). In another embodiment, a plurality of multipole magnets may be connected downstream to one acceleration cavity (N=1, M>1). In yet another embodiment, one multipole magnet may be connected downstream to a plurality of acceleration cavities (N>1, M=1) or a plurality of multipole magnets may be connected downstream to a plurality of acceleration cavities (N>1, M>1). A mode (N>1) in which a plurality of acceleration cavities are connected particularly produces a high-energy beam and is suitably usable when an effect of spread of the beam is relatively small. Upper limits of N and M can be set as appropriate within a range where effects of the present invention can be obtained. For example, N is preferably 4 or lower and more preferably 2 or lower. M is also preferably 4 or lower and more preferably 2 or lower.

In the present invention, while the multipole magnet may typically be a quadrupole magnet, a sextupole magnet, an octupole magnet, a decapole magnet, a solenoid magnet, and the like can also be adopted. In addition, adjacent multipole magnets (an acceleration cavity may be included therebetween) may preferably be arranged so that directions of convergence differ from one another. While magnets may be permanent magnets or electromagnets, adopting permanent magnets achieves energy saving.

Each of the plurality of acceleration cavities according to the present invention may preferably include a power supplying unit which independently supplies radiofrequency power.

As described above, in the accelerator according to the present invention, since convergence of a beam is performed by a magnetic field method, required voltage inside an acceleration cavity does not vary nor does it exceed a discharge power limit even when an inner diameter (hereinafter, a bore diameter) of a cylinder or the like for allowing passage of the beam is increased. In other words, since the accelerator according to the present invention enables the bore diameter to be increased, high-intensity beams can be received. For example, the accelerator according to the present invention enables the bore diameter to be set to 2 cm or more.

In addition, since the acceleration cavity according to the present invention has one or two acceleration gaps, the number of radiofrequency coupling systems (RF couplers) per one acceleration cavity can be reduced to one or a few (for example, two or four). Although it is difficult to arrange a large number of RF couplers in one acceleration cavity, an arrangement of one or a few RF couplers can be readily realized and input to each RF coupler can be controlled by a digital circuit. Furthermore, according to the present invention, since an acceleration gradient of the acceleration gaps can be increased, the total length of the accelerator can be reduced.

In addition, enabling radiofrequency power to be individually supplied to the acceleration cavities significantly improves freedom of design of the apparatus. In an RFQ accelerator, spacing between adjacent gaps must be set to $\beta\lambda/2$ (where $\beta$=velocity/speed of light, $\lambda$=wavelength of radiofrequency wave, and $\beta\lambda$=distance traveled by a particle in one period), and the higher the velocity of a beam becomes, the larger the intergap spacing must be. With the accelerator according to the present invention, since a phase of radiofrequency waves can be independently controlled, spacing of acceleration cavities can be freely designed. In other words, intergap spacing can be reduced and the total length of the accelerator can be reduced. In addition, an adiabatic capture function similar to that of RFQ can be imparted in a front stage of the accelerator.

Another aspect of the present invention is an accelerator system in which a plurality of accelerators are connected, and at least a front-stage accelerator (an initial-stage accelerator) which receives input of a DC beam from a beam generation source and which has a function of adiabatically capturing the beam is the accelerator described above. All of the accelerators in the accelerator system according to the present aspect may be the accelerator described above.

The accelerator or the accelerator system according to the present embodiment may accelerate, as a continuous (CW) beam, an ion beam with a large current of at least 0.1 A and more suitably at least 1 A. In the present disclosure, a continuous beam is a beam in which ions are bunched from a microscopic perspective but ions are continuous from a macroscopic perspective. For example, a 1 A continuous beam is a beam of which an average current is 1 A. On the other hand, a beam that is also continuous from a microscopic perspective is referred to as a DC beam and a beam that is intermittent from a macroscopic perspective is referred to as a pulse beam.

Advantageous Effects of Invention

According to the present invention, a low-cost accelerator capable of generating high-intensity beams can be realized.

BRIEF DESCRIPTION OF DRAWINGS

FIG. 8 is a table illustrating an advantageous effect of the linear accelerator system 100 according to the present embodiment.

DESCRIPTION OF EMBODIMENTS

An embodiment of the present invention will be described with reference to the drawings.

<Configuration>

Figure 1:
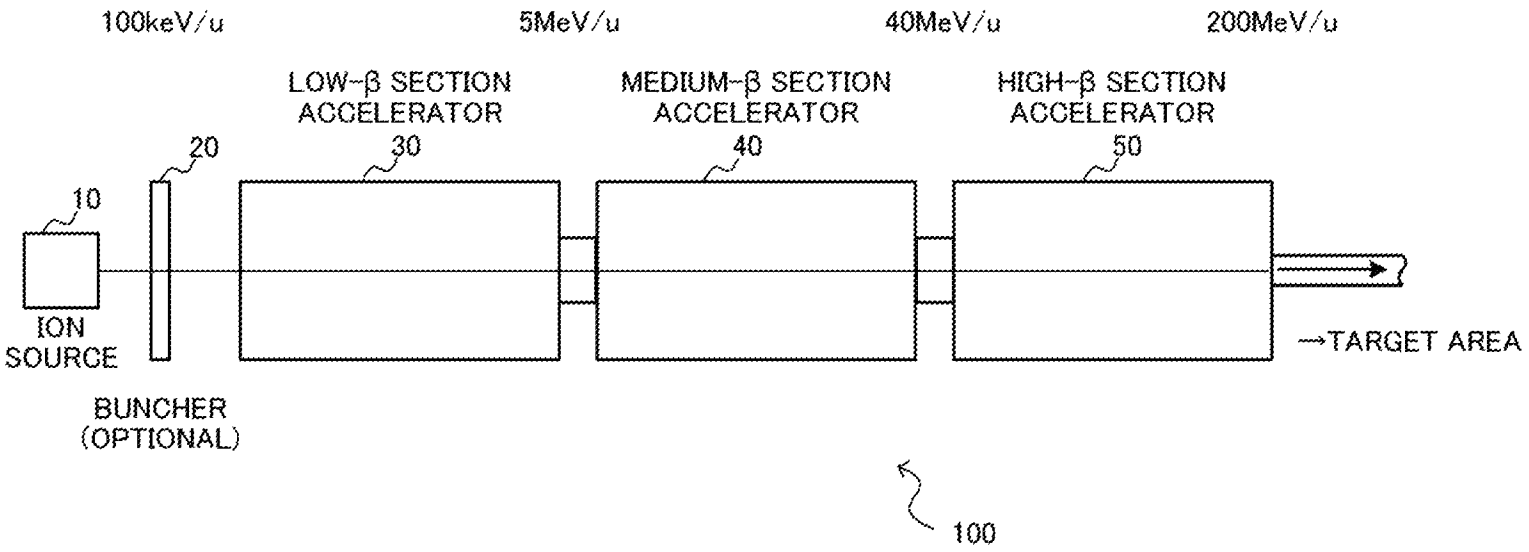
FIG. 1 is a diagram showing a schematic configuration of a linear accelerator system 100 according to a present embodiment.

The present embodiment is a 100 MW-class linear accelerator system 100 which accelerates a deuteron or proton continuous (CW) ion beam of approximately 1 A up to 100 MeV per nucleon (hereinafter, 100 MeV/u, a similar expression applies to same types of descriptions). FIG. 1 is a diagram showing a schematic configuration example of the linear accelerator system 100 according to the present embodiment. In the present specification, a linear accelerator system is a term that collectively refers to an entirety of a plurality of cascade-connected accelerators.

Generally, the linear accelerator system 100 includes an ion source 10, a buncher 20, a low-β (low velocity) section accelerator 30, a medium-β (medium velocity) section accelerator 40, and a high-β (high velocity) section accelerator 50.

The ion source (a beam generation source) 10 is a cusped ion source (also known as an electron impact ion source) which forms a cusped magnetic field inside a plasma generation container. The ion source 10 ionizes gas to generate a plasma and extracts ion with a 30 kV electric field. The ion source 10 extracts beams from 30 porous electrodes in order to obtain an ion beam of 1 A. Since excessively focusing a beam results in an excessive space-charge force, a single hole diameter is around 1 cm and a diameter of an entire beam extracted from the ion source 10 is around 10 cm or more.

The buncher 20 bunches the ion beam extracted from the ion source 10 without accelerating the ion beam. Since the low-β section accelerator 30 also has a beam-bunching function, the buncher 20 may be omitted. Energy of the ion beam extracted from the ion source 10 ranges from 50 to 300 keV/u. In a practical example shown in FIG. 1, the energy of the ion beam is 100 keV/u.

The low-β section accelerator 30 is a front-stage accelerator (an initial-stage accelerator) which initially accelerates an ion beam generated by the ion source 10. Hereinafter, the low-β section accelerator 30 will also be simply referred to as an accelerator 30. The accelerator 30 accelerates ions up to 2 to 7 MeV/u. The practical example shown in FIG. 1 represents an example in which ions are accelerated up to 5 MeV/u. The accelerator 30 has a bore diameter of 10 cm or more in order to receive beams generated by the ion source 10.

Figure 2:
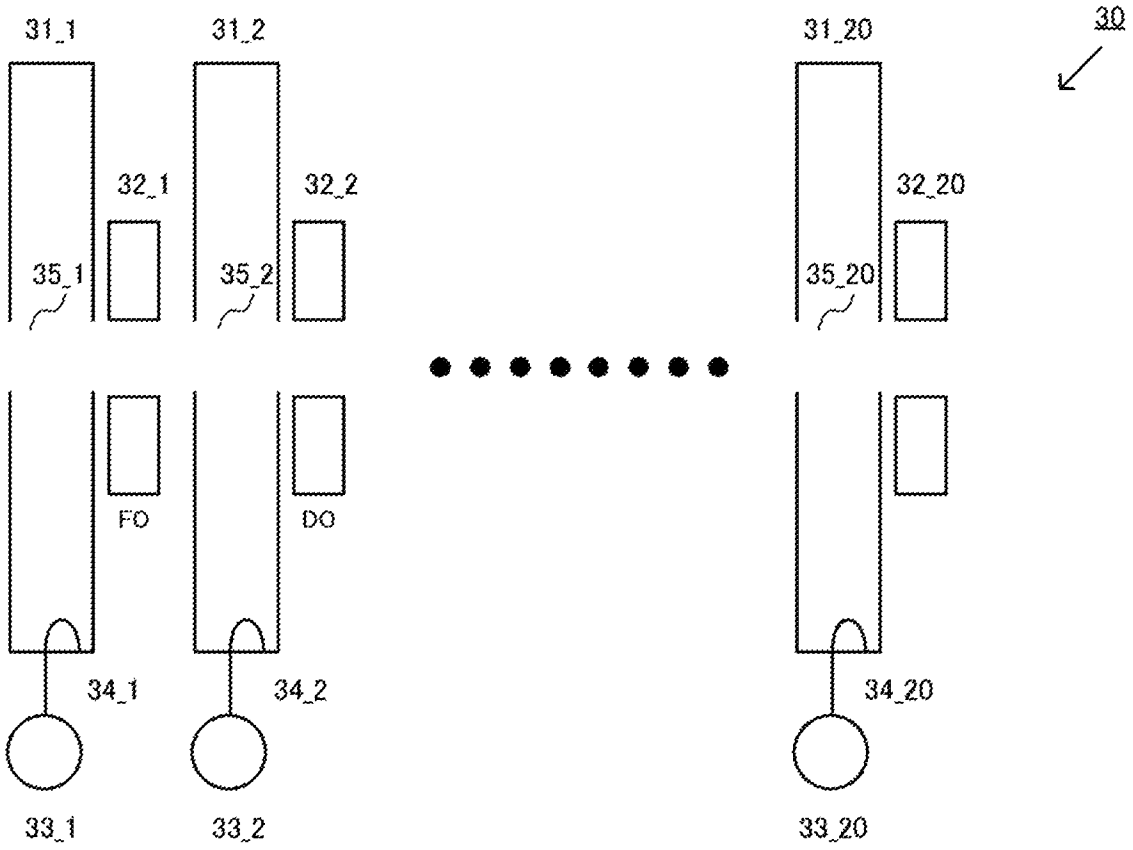
FIG. 2 is a diagram showing a schematic configuration of a low-β section accelerator 30 according to the present embodiment.

A more specific configuration of the accelerator 30 will be described with reference to FIG. 2. As shown in FIG. 2, the accelerator 30 is configured such that around 20 acceleration cavities 31_1, 31_2, . . . , 31_20 and around 20 quadrupole magnets (Q magnets) 32_1, 32_2, . . . , 32_20 are alternately connected. Since the respective acceleration cavities and the respective Q magnets share similar configurations, hereinafter, suffixes will be omitted and collective references in the form of an acceleration cavity 31 and a Q magnet 32 will be made.

The acceleration cavity 31 is a single-gap cavity having a single acceleration gap 35. Radiofrequency power (an oscillating electric field) is supplied to the acceleration cavity 31 from a radiofrequency power supplying unit 33 via an RF coupler (a radiofrequency coupling system) 34. The radiofrequency power supplying unit 33 supplies the radiofrequency power in a phase in which ions are accelerated when passing through the acceleration gap 35. In the example of the present embodiment shown in FIG. 1, acceleration voltage is 300 kV and frequency is 25 MHz.

The radiofrequency power supplying unit 33 provided in each acceleration cavity 31 is capable of independently controlling a phase of radiofrequency waves. Therefore, since ions can be accelerated by determining each phase in accordance with spacing between adjacent acceleration cavities (spacing between acceleration gaps), spacing of acceleration cavities can be freely set.

As described above, motion and behavior of ions in a direction of travel or, in other words, acceleration and adiabatic capture are controlled by the radiofrequency power (an oscillating electric field) supplied by the radiofrequency power supplying unit 33, and the radiofrequency power supplying unit 33 corresponds to the first control means according to the present invention.

Figure 3:
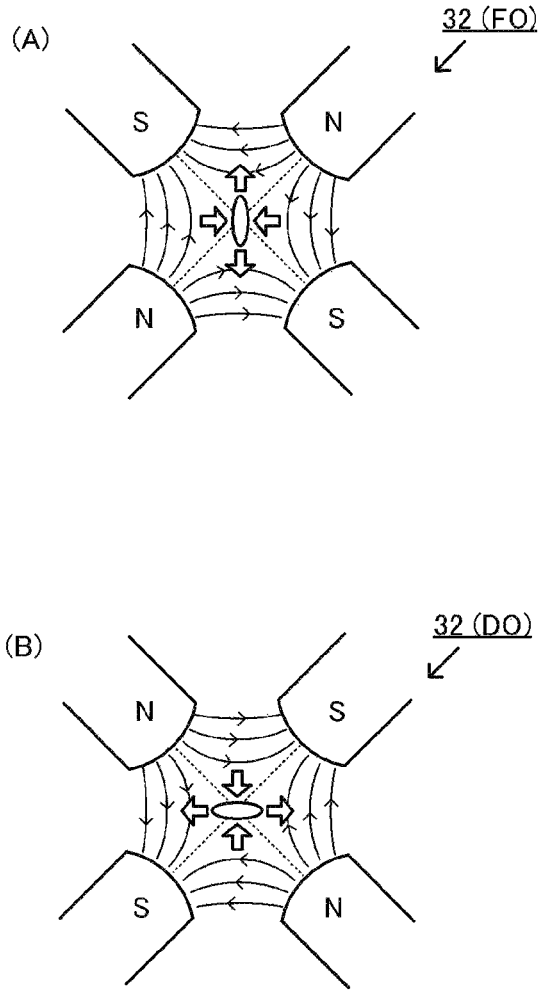
FIG. 3 is a diagram illustrating a quadrupole magnet according to the present embodiment.

As shown in FIGS. 3(A) and 3(B), the quadrupole magnet 32 performs convergence of a beam with a DC magnetic field (a static magnetic field). Directions of convergence of adjacent quadrupole magnets 32 differ from each other. In other words, an F quadrupole (FIG. 3(A)) which causes a beam to converge in a horizontal direction and diverge in a vertical direction and a D quadrupole (FIG. 3(B)) which causes a beam to converge in the vertical direction and diverge in the horizontal direction are alternately arranged. While an intensity of a magnetic field created by the quadrupole magnet 32 is desirably determined in accordance with energy of ions, the intensity is generally around several k gauss. While the quadrupole magnet 32 may be a permanent magnet or an electromagnet, adopting a permanent magnet achieves energy saving.

Due to the DC magnetic field supplied by the quadrupole magnet 32, a motion and behavior of ions in a transverse direction or, in other words, convergence of the ions is controlled. The quadrupole magnet 32 corresponds to the second control means according to the present invention.

The medium-β section accelerator 40 is an accelerator which further accelerates an ion beam accelerated by the low-β section accelerator 30. Hereinafter, the medium-β section accelerator 40 will also be simply referred to as an accelerator 40. The accelerator 40 accelerates ions up to 10 to 50 MeV/u. The practical example shown in FIG. 1 represents an example in which ions are accelerated up to 40 MeV/u.

A more specific configuration of the accelerator 40 will be described with reference to FIG. 4(A). The accelerator 40 is similar to the accelerator 30 in principle and is configured such that 10 acceleration cavities 41 and 10 Q magnets 42 are alternately connected.

The acceleration cavity 41 is a double-gap cavity having two acceleration gaps 46 and 47. Radiofrequency power is supplied to the acceleration cavity 41 from a radiofrequency power supplying unit 43 via an RF coupler (a radiofrequency coupling system) 44. There may be one RF coupler 44 or a plurality of RF couplers 44. In addition, the RF coupler 44 controls a phase of the radiofrequency power with a digital circuit. The radiofrequency power supplying unit 43 supplies the radiofrequency power in a phase in which ions are accelerated when passing through the acceleration gaps 45 and 46. The present embodiment shown in FIG. 1 represents an example of acceleration conditions including acceleration voltage of 2.5 MV and frequency of 50 MHz.

Figure 4:
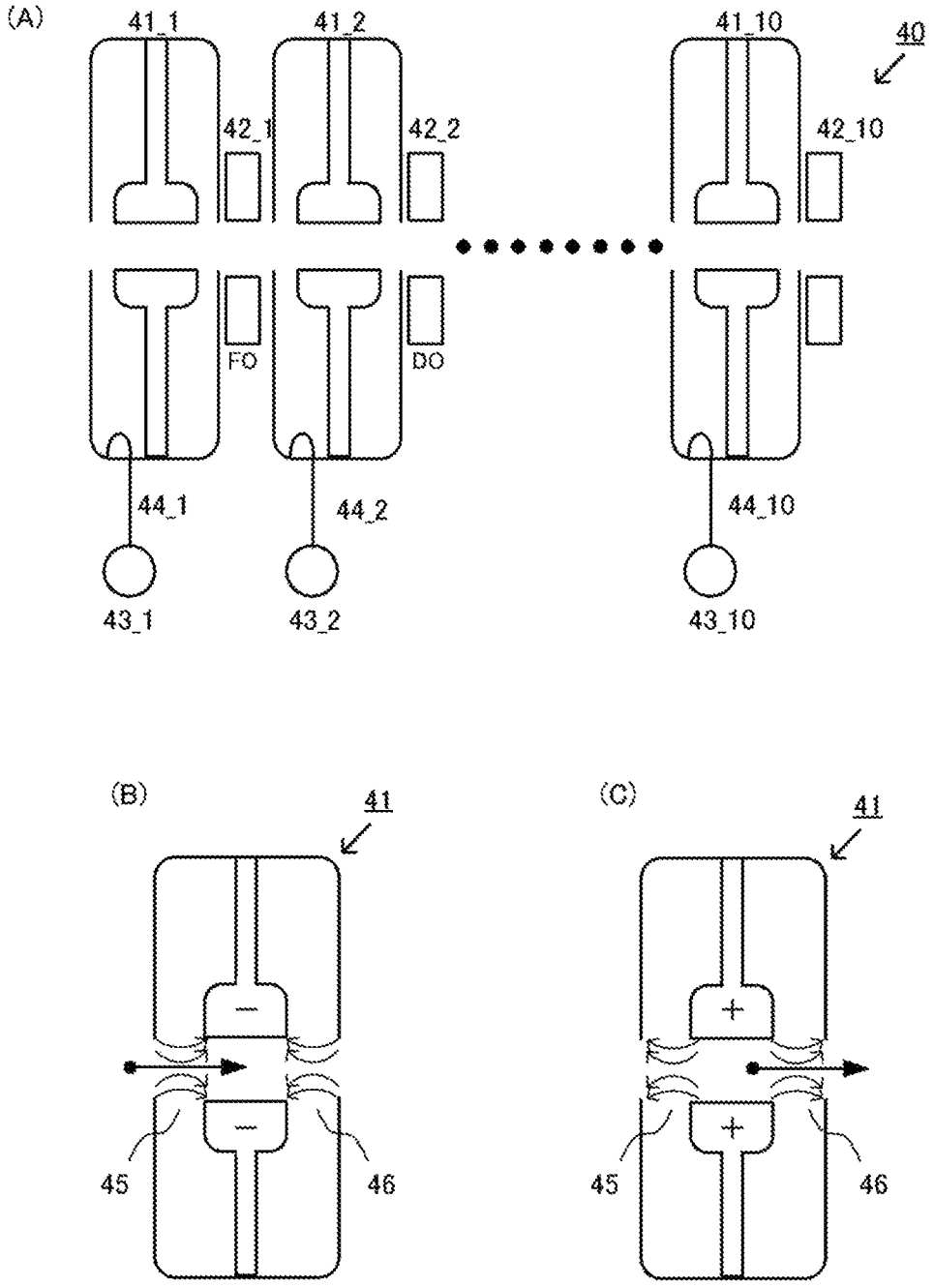
FIG. 4 is a diagram showing a schematic configuration of a medium-β section accelerator 40 according to the present embodiment.

As shown in FIGS. 4(B) and 4(C), since phases of radiofrequency waves must be reversed between when ions pass through the acceleration gap 46 and when ions pass through the acceleration gap 47, a distance between the acceleration gap 46 and the acceleration gap 47 must match a distance ($\beta\lambda/2$) which is traveled during ½ period of a radiofrequency wave. On the other hand, spacing between adjacent acceleration cavities 41 can be freely set.

In the Q magnet 42, F quadrupoles and D quadrupoles are alternately arranged.

The high-β section accelerator 50 is an accelerator which further accelerates an ion beam accelerated by the medium-β section accelerator 40. Hereinafter, the high-β section accelerator 50 will also be simply referred to as an accelerator 50. The accelerator 50 accelerates ions up to 75 to 1,000 MeV/u. The practical example shown in FIG. 1 represents an example in which ions are accelerated up to 200 MeV/u.

Figure 5:
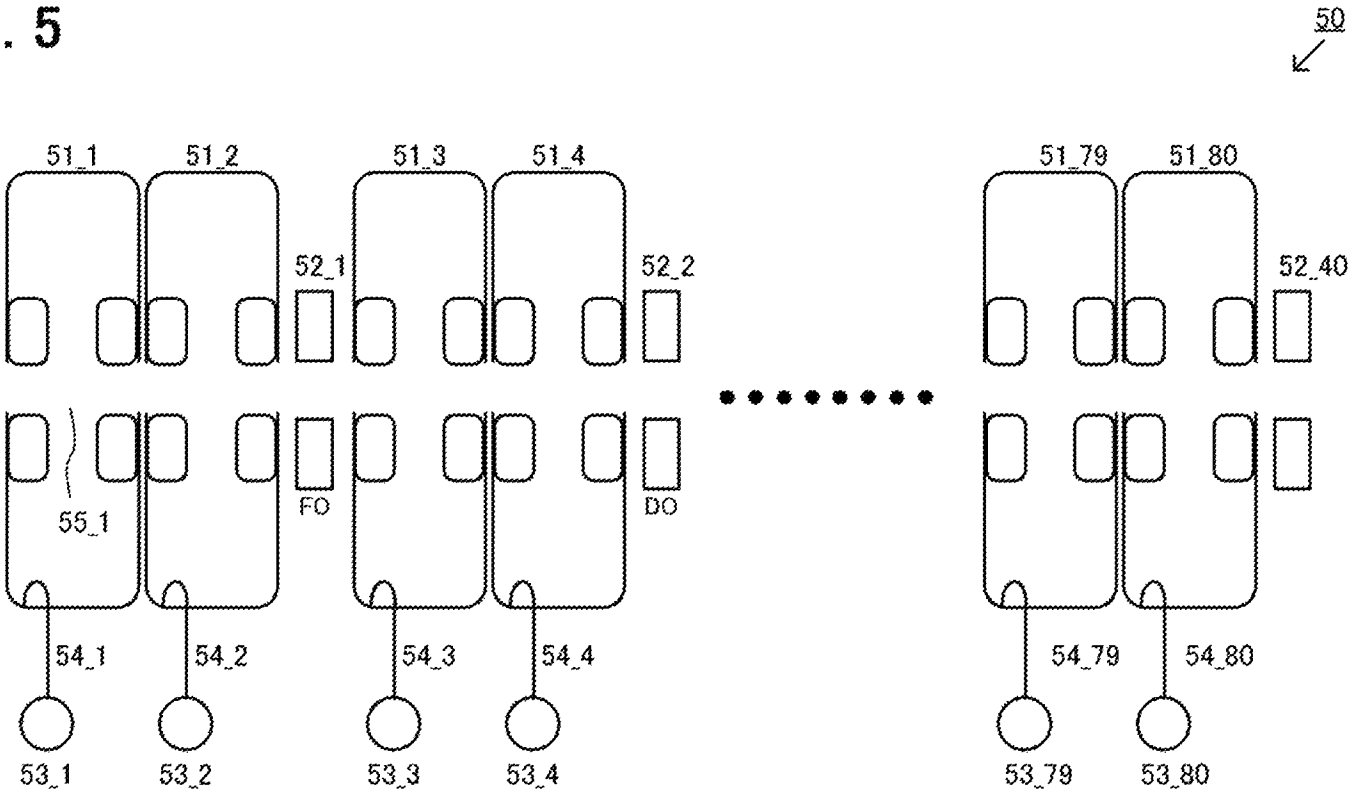
FIG. 5 is a diagram showing a schematic configuration of a high-β section accelerator 5 according to the present embodiment.

A more specific configuration of the accelerator 50 will be described with reference to FIG. 5. Although the accelerator 50 is similar to the accelerators 30 and 40 in principle, a configuration in which one Q magnet 52 is connected downstream to two acceleration cavities 51 is repeated. This is an example in which, as a result of determining acceleration conditions, there are a total of 80 acceleration cavities 51 and 40 Q magnets 52.

The acceleration cavity 51 is a single-gap cavity having a single acceleration gap 55. Radiofrequency power is supplied to the acceleration cavity 51 from a radiofrequency power supplying unit 53 via an RF coupler (a radiofrequency coupling system) 54. The radiofrequency power supplying unit 53 supplies the radiofrequency power in a phase in which ions are accelerated when passing through the acceleration gap 55. The example of the present embodiment represents an example of determining acceleration conditions including acceleration voltage of 2.5 MV and frequency of 100 MHz.

In the Q magnet 52, F quadrupoles and D quadrupoles are alternately arranged. One Q magnet 52 is arranged for every two acceleration cavities 51 in the accelerator 50 because, given that energy of a beam is high, an effect of spread of the beam is relatively small.

The beam accelerated by the accelerator 50 is guided to a target area via a high-energy beam transportation system.

<Acceleration Condition Determination Process>

Determination methods of a voltage and a phase of a radiofrequency magnetic field and a magnetic field gradient of a Q magnet in each acceleration gap will be described. The acceleration conditions can be determined by similar processing for all sections. Therefore, hereinafter, the low-β section accelerator 30 will be mainly described as an example.

Let us assume that an apparatus structure (a shape and a size) of accelerators is given. Let us also assume that to what degree ions are to be accelerated in each accelerator is also given as a condition.

Figure 6:
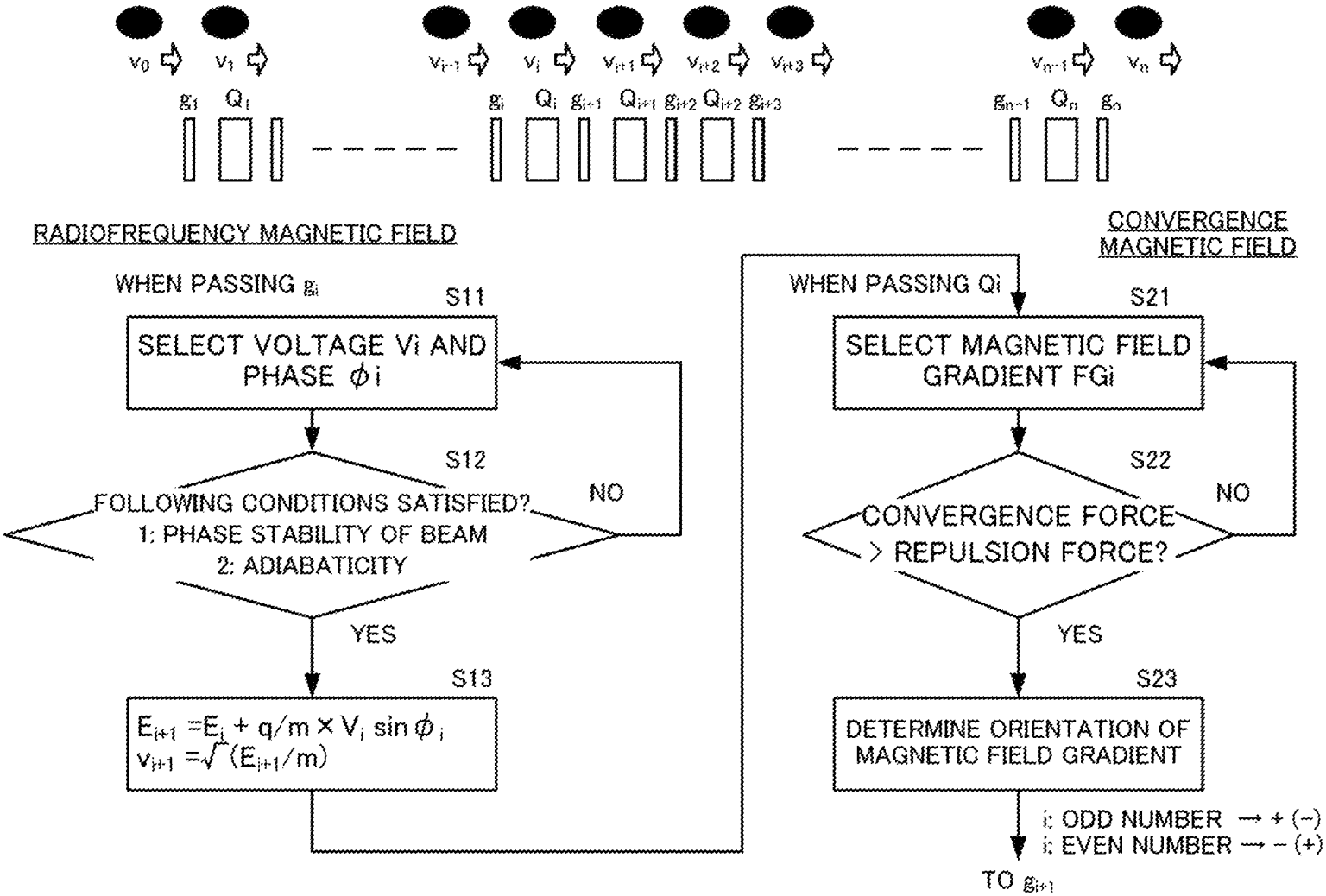
FIG. 6 is a flow chart of an acceleration condition determination process according to the present embodiment.

An acceleration condition determination process in the low-β section accelerator 30 will now be described with reference to FIG. 6. An upper part of FIG. 6 schematically shows an acceleration gap g and a quadrupole magnet Q of the accelerator 30 and a bunching velocity v depicted by a block dot. Note that an i-th acceleration gap will be denoted by $g_i$, an i-th Q magnet will be denoted by $Q_i$, and a bunching velocity after passing the acceleration gap $g_i$ will be denoted by $v_i$.

The flow chart shown in FIG. 6 represents processing for determining a radiofrequency magnetic field and a convergence magnetic field for one stage. The processing is realized by a computer by executing a program.

Steps S11 to S13 are steps of processing for determining $V_i$ and $\phi_i$ and steps S21 to S23 are steps of processing for determining $FG_i$. $V_i$ denotes an amplitude of a radiofrequency electric field to be applied to the acceleration gap $g_i$, and $\phi_i$ denotes a phase of an oscillating electric field when a center of a bunch passes through the acceleration gap $Q_i$ denotes a magnetic field gradient of the Q magnet $Q_i$ which has a positive value in cases of horizontal convergence and vertical divergence and a negative value in cases of vertical convergence and horizontal divergence.

First, processing for determining a radiofrequency electric field of the acceleration gap $g_i$ will be described. In step S11, $V_i$ and $\phi_i$ are selected. In addition, in step S12, a determination is made as to whether or not phase stability of a beam and adiabaticity are satisfied.

Figure 7:
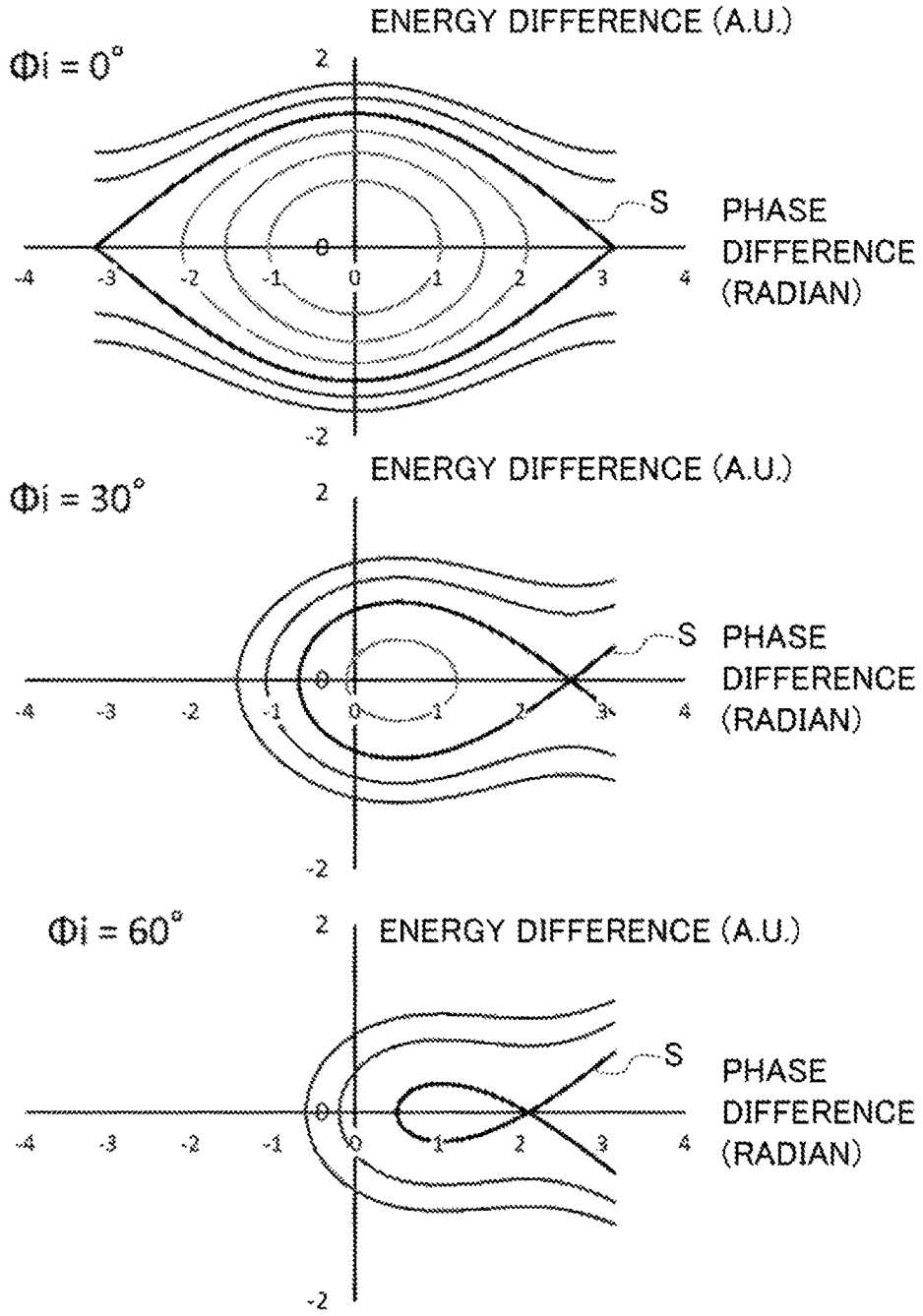
FIG. 7 is a diagram illustrating phase stability of a beam.

Phase stability can be determined based on whether or not a beam is positioned within a stable region in a phase space defined by a phase difference from a synchronous particle and an energy difference from the synchronous particle. FIG. 7 shows stable regions where $\phi_i$=0°, $\phi_i$=30°, and $\phi_i$=60°. A solid line S represents separatrix (a stability limit) and inside thereof is a stable region. In other words, a beam is stable when the beam is positioned inside the stable region described above in a phase space.

An adiabatic condition is a condition requiring that a variation of a stable space is sufficiently gradual as compared to a synchrotron oscillation of a beam. Specifically, when a synchrotron oscillation frequency is denoted by Ωs, the condition requires that $(1/\Omega s)\times d\Omega s/dt \ll \Omega s$.

In step S12, when phase stability and adiabaticity are not satisfied, the processing returns to step S1 to once again select $V_i$ and $\phi_i$. When the conditions of step S12 are satisfied, $V_i$ and $\phi_i$ in the acceleration gap $g_i$ are determined as the values selected in step S11. Note that $V_i$ and $\phi_i$ are desirably determined so that highest acceleration efficiency is attained within a range satisfying the conditions of step S12.

In step S13, non-relativistic energy $E_{i+1}$ and non-relativistic velocity $v_{i+1}$ of the beam after passing through the acceleration gap $g_i$ are calculated. Since energy increases by $q/m\times V_i \sin\phi_i$ in the acceleration gap $g_i$, $=E+q/m\times V_i \sin\phi_i$. Note that m denotes a mass of an ion and q denotes an amount of charge of the ion.

Next, processing for determining a magnetic field gradient $FG_i$ of the Q magnet $Q_i$ will be described. In step S21, $FG_i$ is selected. In addition, in step S22, a determination is made as to whether a condition requiring that a convergence force of the Q magnet exceed a repulsion force due to the space-charge force or, in other words, whether a condition requiring stability in a transverse direction is satisfied. When the condition of step S22 is not satisfied, the processing returns to step S21 to once again select $FG_i$. When the condition of step S22 is satisfied, the processing advances to step S23 to determine an orientation of the magnetic field gradient. For example, the magnetic field gradient is set to a positive direction for odd-numbered Q magnets but the magnetic field gradient is set to a negative direction for even-numbered Q magnets. It is needless to say that positive and negative may be reversed.

According to the processing described above, acceleration conditions in the i-th acceleration gap $g_i$ and the i-th Q magnet $Q_i$ are determined. The processing described above are sequentially performed with respect to all acceleration gaps and Q magnets starting from i=1. Accordingly, all $g_i$, $\phi_i$, and $FG_i$ in the accelerator 30 are determined. While the low-β section accelerator 30 has been described as an example, acceleration conditions are determined in a similar manner with respect to acceleration in other sections.

Vi and ϕi are determined as described below.

FIG. 7 reveals that the smaller a value of ϕi, the wider the stable region and, when ϕi=0, almost all of a beam can be captured in a stable region even if the beam is a DC beam. Subsequently, ϕi and Vi are set as appropriate and adiabatic capture is performed with respect to the direction of travel.

Vi may be arbitrarily determined as long as the adiabatic condition described earlier is satisfied. Since FIG. 6 reveals that a small $\phi i$ value means low acceleration voltage, while $\phi i$ is preferably increased to a value ($\phi a$, for example, 60°) at which ordinary acceleration is performed as quickly as possible for the purpose of improving acceleration efficiency, it is important that $\phi i$ is gradually varied to ensure that the beam does not spill out from the stable region for the purpose of satisfying the adiabatic condition described earlier.

A frequency is not fixed across all regions of the accelerator system and, for example, the frequency of the radiofrequency electric field is increased such that a frequency of the medium-$\beta$ section is K times that of the low-$\beta$ section and a frequency of the high-$\beta$ section is L times that of the low-$\beta$ section in order to make the entire accelerator system more compact. In doing so, attention must be paid to the fact that a spread in a phase direction of the beam shown in FIG. 7 increases by a factor of K (L) as the frequency varies. Therefore, in an initial stage of medium-$\beta$ and high-$\beta$, $\phi i$ is set slightly lower than $\phi a$ to widen the stable region, and after the beam is captured in the stable region without any spilling, $\phi i$ is gradually (adiabatically) brought close to $\phi a$.

Since the accelerator according to the present embodiment is an arrangement of a plurality of single-gap or double-gap acceleration cavities, a voltage and a phase of a radiofrequency electric field can be determined as described above for each acceleration cavity.

Advantageous Effects

Hereinafter, advantages of the linear accelerator system 100 according to the present embodiment will be described based on a comparison with an International Fusion Material Irradiation Facility (IFMIF). The IFMIF is a 10 MW-class accelerator which emits two deuteron beams (40 MeV, 125 mA×2).

FIG. 8 is a table which compares characteristics (column 601) of an RFQ accelerator that is an initial-stage accelerator in an IFMIF, characteristics (column 602) when a bore diameter of the RFQ accelerator in the IFMIF is simply increased by ten times, and characteristics (column 603) of the initial-stage accelerator 30 according to the present embodiment.

Since the RFQ accelerator performs convergence of a beam in the horizontal direction according to an electric field system, increasing the bore diameter by ten times also increases required voltage by ten times (80 kV→800 kV). As a result, a discharge power limit is exceeded. In contrast, since the accelerator according to the present embodiment performs convergence of a beam in the horizontal direction according to a magnetic field system that uses Q magnets, there is no need to apply high voltage to cause the beam to converge even when the bore diameter is increased and can be realized within the discharge power limit.

In addition, since radiofrequency loss is proportional to a square of voltage, increasing the bore diameter of the RFQ accelerator by ten times results in an enormous increase in radiofrequency loss of 100 times (1 MV→100 MW). In contrast, radiofrequency loss in the accelerator according to the present embodiment can be kept to or below 10 MW.

Furthermore, in an RFQ accelerator, spacing between acceleration gaps must be set to $\beta\lambda/2$. In contrast, with the accelerator according to the present embodiment, since a phase of radiofrequency waves can be independently controlled for each acceleration cavity, the spacing of acceleration cavities can be freely designed. When the acceleration cavities have a single acceleration gap, this means that the spacing of all acceleration gaps can be freely designed. Therefore, the spacing of acceleration gaps can be shortened and a reduction of the total length of the acceleration apparatus can be achieved. When one acceleration cavity has a plurality of acceleration gaps, while the constraint described above applies to the spacing between acceleration gaps inside the acceleration cavity, since the spacing between acceleration cavities can be shortened, the total length can be reduced as compared to conventional examples. In addition, reducing the total length of accelerators enables production cost to be reduced.

An RFQ accelerator not only accelerates a beam and causes the beam to converge in the horizontal direction but also has a function of adiabatically capturing the beam in the direction of travel. In a similar manner, the accelerator according to the present embodiment is also capable of adiabatically capturing a beam in the direction of travel.

In addition, although not shown in the table in FIG. 8, another advantage is that the number of RF couplers per one acceleration cavity can be reduced. Since there is a limit to power that can be supplied from one RF coupler, radiofrequency power must be supplied from a plurality of RF couplers. For example, at least 8 or 9 RF couplers are needed to supply power of 500 kW. It is difficult to connect such a large number of RF couplers in one acceleration cavity, and it is virtually impossible to increase an acceleration gradient through further extension. In contrast, since the accelerator according to the present embodiment need only one RF coupler per one acceleration cavity, the acceleration cavity can be readily realized and, at the same time, the acceleration gradient can also be increased by increasing the number of RF couplers.

In the present embodiment, since individually controlling acceleration cavities increases freedom of control and eliminates the need for RFQ accelerators, enlargement of a beam current can be realized. In addition, by appropriately selecting the number of stages of acceleration cavities (cells) in accordance with an overall capacity and specifications of an accelerator system, for example, an accelerator subsystem for a low-velocity region can be constructed and adequate control can be realized in correspondence with a velocity region. Furthermore, a manufacturing method can be adopted in which a plurality of accelerators corresponding to respective velocity regions are manufactured at another location, the accelerators are individually transported to an installation location of an accelerator system, and an entire system is constructed by assembling subsystems of respective velocity regions, in which case various adjustments can be performed on-site after assembly on a cell-by-cell basis in a flexible manner.

As is apparent from the description given above, while acceleration and convergence of a beam are performed based on control by an oscillating electric field in an RFQ accelerator, in the present embodiment, the two are partitioned and separated in such a manner that the former is controlled based on an oscillating electric field and the latter is controlled based on a static magnetic field and are performed as represented by a procedure shown in, for example, FIG. 6. In particular, a behavior of a beam in a cavity that is closest to an ion generation source has no small effect on the behavior of the beam in a cavity in a subsequent stage and also affects controllability of the beam in the subsequent stage. In this manner, the behavior of a beam in a cavity of a specific stage has a recurrence formula-like effect on beam behavior, control thereof, and the like in cavities of subsequent stages. Therefore, performing partitioning control of the electric field and the magnetic field described above, particularly in the cavity that is closest to the ion generation source, has great significance when considering an effect to a subsequent stage and, by extension, to an entire system.

<Modifications>

The configurations of the embodiment described above can be appropriately modified without departing from the technical ideas of the present invention. The specific parameters used in the embodiment described above are simply examples and may be suitably modified as necessary.

While the bore diameter (inner diameter) of the accelerator is set to 10 cm in the embodiment described above, the bore diameter may be smaller or larger. Considering that a bore diameter that can be realized by a conventional RFQ accelerator is around 1 cm, setting the bore diameter of the accelerator according to the present embodiment to 2 cm or more realizes acceleration of a large-diameter beam that is conventionally not feasible. The bore diameter of the accelerator may be 5 cm or more, 10 cm or more, 20 cm or more, or 50 cm or more.

While the embodiment described above is configured such that one Q magnet is connected to every one or two acceleration cavities, other configurations can also be adopted. For example, a plurality of Q magnets may be continuously arranged. Generally, a configuration can be adopted in which M-number (where M is a natural number) of multipole magnets are connected downstream to N-number (where N is a natural number) of acceleration cavities.

While the linear accelerator system according to the embodiment described above is constituted by three accelerators in a low-β section, a medium-β section, and a high-β section, the linear accelerator system may be constituted by two accelerators or four or more accelerators. In addition, not all accelerators need be accelerators constituted by acceleration cavities having one or two acceleration gaps. While an accelerator of an initial stage is preferably configured in this manner, conventional accelerators may be adopted as the accelerators in second and subsequent stages.

While a proton or a deuteron is assumed as a particle to be accelerated, tritium (tritiated hydrogen) or elements heavier than hydrogen may be accelerated instead.

While a prominent effect of the present invention can be expected when a beam current is around 1 A, a reasonable effect may be produced even when the beam current is at least around 0.1 A.

REFERENCE SIGNS LIST

10 Ion source
20 Buncher
30 Low-β section accelerator
40 Medium-β section accelerator
50 High-β section accelerator
31, 41, 51 Acceleration cavity
32, 42, 52 Quadrupole magnet (Q magnet)
33, 43, 53 Radiofrequency power supplying unit
34, 44, 54 Radiofrequency coupling system
35, 45, 46, 55 Acceleration gap

The invention claimed is:

1. An accelerator, comprising:

a plurality of acceleration cavities each having two acceleration gaps;

a plurality of controllers provided to the plurality of acceleration cavities, respectively; and a plurality of multipole magnets, wherein one or more of the plurality of multipole magnets are connected downstream to one of the plurality of acceleration cavities, wherein the two acceleration gaps of each of the plurality of acceleration cavities are configured for an ion beam to pass therethrough, and the two acceleration gaps are configured to accelerate the ion beam when the ion beam passes through, wherein each of the plurality of controllers generates an oscillating electric field in a corresponding acceleration cavity, independently controls a motion of an ion beam inside the corresponding acceleration cavity, and independently supplies radiofrequency power into the corresponding acceleration cavity via an RF coupler, wherein convergence of the ion beam in a horizontal direction is controlled via a magnetic field caused by the plurality of multipole magnets, and the plurality of controllers controls acceleration of the ion beam independently of the control via the magnetic field, and wherein a distance between adjacent acceleration gaps in one of the plurality of acceleration cavities matches a distance that the ion beam travels during ½ period of the radiofrequency, and a distance between adjacent acceleration cavities is shorter than the distance that the ion beam travels during ½ period of the radiofrequency.

2. The accelerator according to claim 1, wherein the plurality of acceleration cavities and the plurality of multipole magnets are connected alternately one by one.

3. The accelerator according to claim 1, wherein each of the plurality of multipole magnets is a quadrupole magnet, and wherein directions of convergence of adjacent quadrupole magnets differ from each other.

4. The accelerator according to claim 1, wherein a bore diameter of each acceleration cavity of the plurality of acceleration cavities is 2 cm or more.

5. An accelerator system in which a plurality of accelerators are connected, wherein at least a front-stage accelerator which receives input of a DC beam from a beam generation source and which has a function of adiabatically capturing the beam is the accelerator according to claim 1.

6. The accelerator system according to claim 5, wherein the accelerator system accelerates an ion beam of at least 0.1 A as a continuous beam.

7. The accelerator system according to claim 6, wherein all of the plurality of accelerators are each the accelerator, comprising:

a plurality of acceleration cavities each having one or two acceleration gaps;

a plurality of controllers provided to the plurality of acceleration cavities, respectively; and a plurality of multipole magnets, wherein one or more of the plurality of multipole magnets are connected downstream to one of the plurality of acceleration cavities, wherein the one or two acceleration gaps of each of the plurality of acceleration cavities are configured for an ion beam to pass therethrough, and the one or two acceleration gaps are configured to accelerate the ion beam when the ion beam passes through, wherein each of the plurality of controllers generates an oscillating electric field in a corresponding acceleration cavity, independently controls a motion of the ion beam inside the corresponding acceleration cavity, and independently supplies radiofrequency power into the corresponding acceleration cavity via an RF coupler, and wherein convergence of the ion beam in a horizontal direction is controlled via a magnetic field caused by the plurality of multipole magnets, and the plurality of controllers controls acceleration of the ion beam independently of the control via the magnetic field.

* * * * *